US007685998B2

(12) United States Patent
Hartmann et al.

(10) Patent No.: US 7,685,998 B2
(45) Date of Patent: Mar. 30, 2010

(54) METHOD AND DEVICE FOR OPERATING AN INTERNAL COMBUSTION ENGINE

(75) Inventors: Dirk Hartmann, Stuttgart (DE); Henri Barbier, Schweiberdingen (DE); Huiping Li, Weinstadt-Grossheppach (DE)

(73) Assignee: Robert Bosch GmbH, Stuttgart (DE)

( * ) Notice: Subject to any disclaimer, the term of this patent is extended or adjusted under 35 U.S.C. 154(b) by 127 days.

(21) Appl. No.: 11/885,923

(22) PCT Filed: Feb. 17, 2006

(86) PCT No.: PCT/EP2006/060051

§ 371 (c)(1),
(2), (4) Date: May 13, 2008

(87) PCT Pub. No.: WO2006/094892

PCT Pub. Date: Sep. 14, 2006

(65) Prior Publication Data

US 2008/0236540 A1 Oct. 2, 2008

(30) Foreign Application Priority Data

Mar. 8, 2005 (DE) ..... 10 2005 011 027

(51) Int. Cl.
*F02D 11/10* (2006.01)
*F02D 41/36* (2006.01)
*F02D 15/04* (2006.01)
*F02D 17/02* (2006.01)

(52) U.S. Cl. ..... 123/481; 123/198 F

(58) Field of Classification Search ..... 123/481, 123/198 D, 436; 701/102, 103, 112
See application file for complete search history.

(56) References Cited

U.S. PATENT DOCUMENTS

| | | | | |
|---|---|---|---|---|
| 6,035,252 | A * | 3/2000 | Dixon et al. | 701/102 |
| 6,138,636 | A * | 10/2000 | Kohno et al. | 123/198 F |
| 6,373,144 | B2 * | 4/2002 | Frohlich et al. | 290/40 R |
| 6,655,353 | B1 * | 12/2003 | Rayl | 123/436 |
| 6,901,327 | B2 * | 5/2005 | Bidner et al. | 701/112 |
| 2003/0213469 | A1 | 11/2003 | Rayl | |
| 2005/0076882 | A1 * | 4/2005 | Rayl | 123/198 F |

FOREIGN PATENT DOCUMENTS

EP 0 875 673 11/1998

* cited by examiner

*Primary Examiner*—Stephen K Cronin
*Assistant Examiner*—Arnold Castro
(74) *Attorney, Agent, or Firm*—Kenyon & Kenyon LLP

(57) ABSTRACT

A method and a device for operating an internal combustion engine, in particular of a motor vehicle, permitting optimal compensation of all losses of the internal combustion engine in half-engine operation. The internal combustion engine has several cylinder banks, at least a first cylinder bank being deactivatable, and, during deactivation of the first cylinder bank, the first cylinder bank losses and the losses of a second cylinder bank being taken into account during activation of the second cylinder bank, and the default value of the second cylinder bank quantity being formed in several steps. In at least one of these steps, the first cylinder bank losses and the second cylinder bank losses are taken into account for forming the default value.

10 Claims, 1 Drawing Sheet

METHOD AND DEVICE FOR OPERATING AN INTERNAL COMBUSTION ENGINE

FIELD OF THE INVENTION

The present invention is directed to a method and a device for operating an internal combustion engine.

BACKGROUND INFORMATION

Internal combustion engines having a plurality of cylinder banks are already known for motor vehicles, including in which at least one first cylinder bank is deactivatable.

SUMMARY OF THE INVENTION

The method and the device according to the present invention for operating an internal combustion engine having the features of the independent claims have the advantage over the related art that losses of the first cylinder bank as well as losses of a second cylinder bank are taken into account in activating the second cylinder bank while the first cylinder bank is deactivated. The formation of a default value for an output variable of the second cylinder bank, e.g., a torque, proceeds in several steps, the losses of the first cylinder bank as well as the losses of the second cylinder bank being taken into account when forming the default value in at least one of these steps. In this way, optimal torque loss compensation is also ensured for the case in which the first cylinder bank is deactivated. Losses of the first cylinder bank may thus be calculated at the same point in forming the default value as the losses of the second cylinder bank, so that the default value may be formed as accurately as possible and for comfortable operation of the internal combustion engine.

Advantageous refinements of and improvements on the method characterized in the main claim are possible through the measures characterized in the subclaims.

The losses of the first cylinder bank and the losses of the second cylinder bank may be taken into account particularly easily if, in one of the steps for forming the default value, a joint loss value which is taken into account in forming the default value is formed from the losses of the first cylinder bank and the losses of the second cylinder bank.

Torque loss compensation during deactivation of the first cylinder bank may be further improved if formation of the default value in multiple steps is influenced by taking into account the losses of the first cylinder bank as well as the losses of the second cylinder bank.

It is advantageous in particular if the losses of the first cylinder bank and the losses of the second cylinder bank are taken into account in a step for converting an operating element position into a first default value for the output variable of the second cylinder bank. In this way a minimum value for the first default value may be formed precisely, i.e., correctly, in particular from the losses of the first cylinder bank and the losses of the second cylinder bank, this minimum value being allocated to an operating element that has been released.

Another advantage is obtained when the losses of the first cylinder bank and the losses of the second cylinder bank are taken into account in a step for forming a second default value for the output variable of the second cylinder bank by filtering a clutch zero crossing of the default value for the output variable of the second cylinder bank. It is possible in this way to ensure that the clutch zero crossing is ascertained precisely, i.e., correctly, as a function of the losses of the first cylinder bank and the losses of the second cylinder bank and thus comfort in operation of the internal combustion engine is also ensured during deactivation of the first cylinder bank at the time of the clutch zero crossing of the default value for the output variable, i.e., the clutch zero crossing may be accomplished smoothly.

Another advantage is obtained when the losses of the first cylinder bank and the losses of the second cylinder bank are taken into account in a step for forming a third default value for the output variable of the second cylinder bank by coordinating multiple requirements for the output variable of the second cylinder bank. In this way, the requirements for the output variable of the second cylinder bank are still taken into account in the coordination in correct scaling, even during deactivation of the first cylinder bank.

To do so, at least one of the requirements for the output variable of the second cylinder bank may be modified easily as a function of the losses of the first cylinder bank and the losses of the second cylinder bank, in particular by superimposing it on the losses of the first cylinder bank and the losses of the second cylinder bank.

An exemplary embodiment of the present invention is depicted in the drawing and explained in greater detail in the following description.

BRIEF DESCRIPTION OF THE DRAWING

The FIGURE shows a function diagram to illustrate the method according to the present invention and the device according to the present invention.

DETAILED DESCRIPTION

Figure 1:
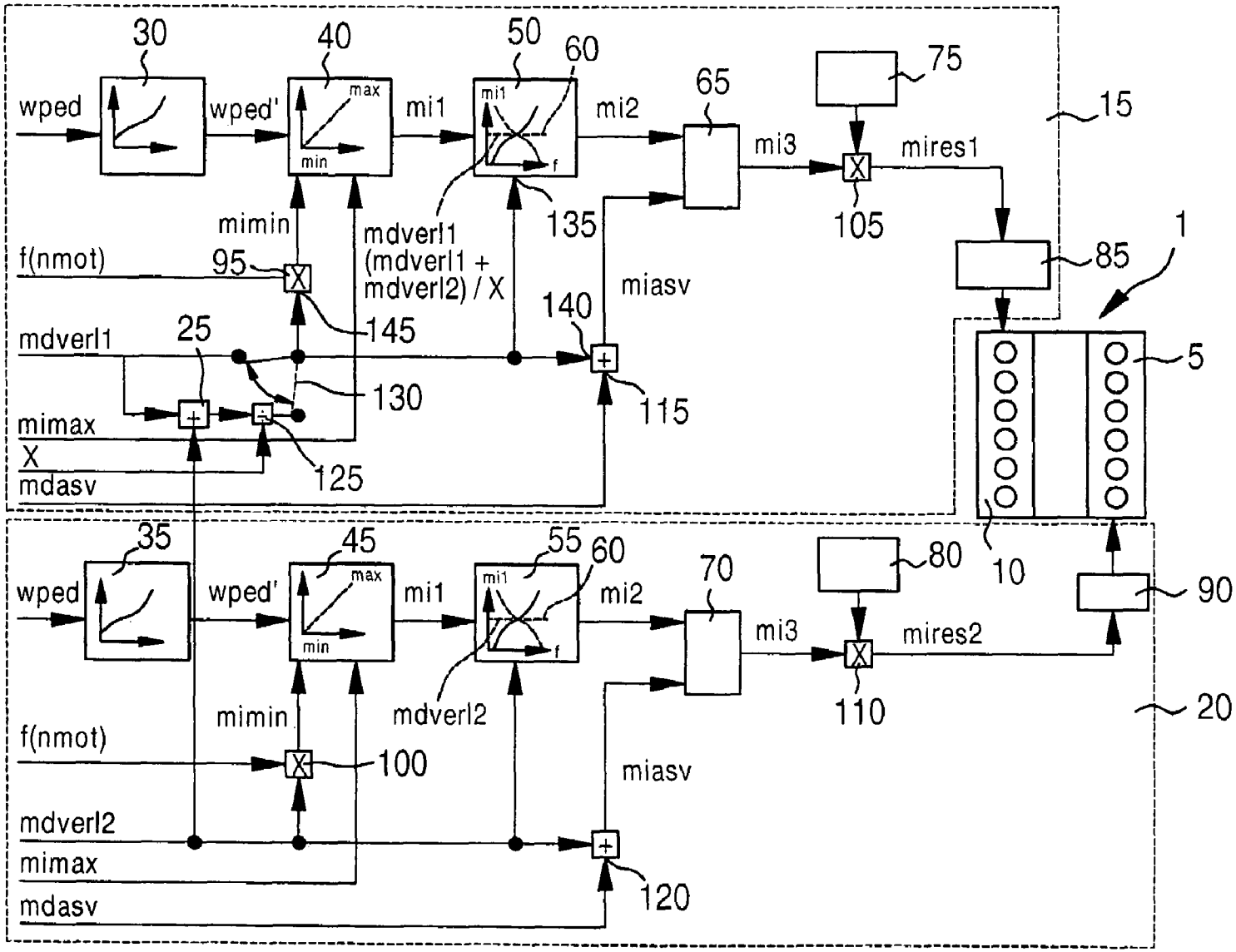

The FIGURE shows an internal combustion engine 1 having a first cylinder bank 5 and a second cylinder bank 10. According to the FIGURE, each of two cylinder banks 5, 10 has six cylinders, forming a 12-cylinder engine, e.g., in the form of a V12 engine or a W12 engine. The exemplary embodiment and/or the exemplary method of the present invention is not limited to a certain number of cylinders per cylinder bank but instead may be used for any number of cylinders per cylinder bank, each of two cylinder banks 5, 10 advantageously having the same number of cylinders. Internal combustion engine 1 may be designed as a gasoline engine or as a diesel engine, for example. Internal combustion engine 1 may drive a motor vehicle, for example. A first control unit 15 and a second control unit 20 are provided for operating, i.e., controlling, internal combustion engine 1. Two control units 15, 20 may each be implemented in terms of software and/or hardware in a single controller or in different controllers.

A driver's intent is measured by an operating element (not shown in the FIGURE), which in this example is embodied as a gas pedal. The driver's intent is derived from position wped of the gas pedal in a manner known to those skilled in the art, e.g., using a potentiometer. Position wped of the gas pedal is sent to first control unit 15 and to second control unit 20. First control unit 15 has a first characteristic curve 30 which corresponds to a second characteristic curve 35 of second control unit 20. The two characteristic curves 30, are thus ideally identical. Position wped of the gas pedal is thus sent to first characteristic curve 30 and to second characteristic curve 35 as an input quantity.

First characteristic curve 30 and/or second characteristic curve 35 converts position wped into a dimensionless factor wped' whose value range includes the real numbers from and including 0 up to and including 1. Dimensionless factor wped' is thus the output variable of first characteristic curve 30 and/or characteristic curve 35. Instead of first characteristic curve 30 and second characteristic curve 35, an engine characteristics map may also be used if other input quantities, e.g., engine speed nmot and engine load, are to be taken into account to form dimensionless factor wped'. Dimensionless factor wped' is sent in first control unit 15 to a first interpolation member 40 and in second control unit 20 to a second interpolation member 45, the two interpolation members 40, 45 being correspondent, i.e., ideally identical. A first default value mi1 is generated as the output variable via first interpolation member 40 and/or second interpolation member 45 from dimensionless factor wped' as an input quantity, first default variable mi1 representing a default variable for an output variable of first cylinder bank 5 and second cylinder bank 10. The output variable of cylinder banks 5, 10 may be, for example, a torque or a power or a quantity derived from torque and/or power. It is assumed below, for example, that the output variable of cylinder banks 5, 10 is a torque, the internal torque generated by cylinder banks 5, 10 being considered here. Quantity mi1 thus constitutes a first setpoint value for the total internal torque to be delivered by internal combustion engine 1 by two cylinder banks 5, 10 together.

In interpolation members 40, 45, dimensionless factor wped' is interpolated between a minimum value mimin and a maximum value mimax for first setpoint value mi1 of the internal torque. This means that minimum value mimin for setpoint value mi1 of the internal torque is assigned to the value zero for dimensionless factor wped', and maximum value mimax for setpoint value mi1 of the internal torque is assigned to value 1 of dimensionless factor wped'. Between these two value range limits of dimensionless factor wped', first interpolation member 40 and second interpolation member 45 interpolate setpoint value mi1 of the internal torque, i.e., between minimum value mimin and maximum value mimax. Minimum value mimin for first setpoint value mi1 of the internal torque is thus set when dimensionless factor wped' is zero, i.e., when the gas pedal has not been operated. Maximum value mimax for first setpoint value mi1 of the internal torque is set when dimensionless factor wped' is equal to 1, i.e., the gas pedal has been pushed all the way to the floor. Minimum value mimin is essentially a function of the losses of internal combustion engine 1, i.e., the total torque loss of internal combustion engine 1, i.e., both cylinder banks 5, 10. The torque loss of internal combustion engine 1 includes engine losses due to charge cycle, friction, etc., as well as operation of secondary equipment, e.g., air conditioner compressor, car radio, etc.

The torque loss of internal combustion engine 1 may be ascertained by a method which is known to those skilled in the art. Torque loss of the internal combustion engine is referred to below as mdverl and is sent to first control unit 15 in the form of a first torque loss mdverl1 and sent to second control unit 20 in the form of a second torque loss mdverl2. When both cylinder banks 5, 10 are activated, then mdverl=mdverl1=mdverl2. In the following, first to be considered is the case when both cylinder banks 5, 10 are activated. A portion of torque loss mdverl or total torque loss mdverl is compensated via minimum value mimin. In the simplest case, torque loss mdverl corresponds to minimum value mimin. Even when the gas pedal has been released, total torque loss mdverl of internal combustion engine 1 is compensated by first setpoint value mi1 of the internal torque in the form of minimum value mimin. In general, the losses of internal combustion engine 1 may also be varied as a function of engine speed nmot to implement overcompensation or undercompensation. To this end, first torque loss mdverl1 is multiplied by aforementioned function f(nmot) of engine speed nmot in a first multiplication member 85 to form minimum value minin. If all losses are compensated exactly, then f(nmot)=1. Accordingly, second torque loss mdverl2 is multiplied by function f(nmot) in a second multiplication member 100 to form minimum value mimin. Maximum value mimax is preselected as the upper interpolation point for the internal torque which is maximally adjustable at the output of internal combustion engine 1. This maximum value mimax is ascertained by a method which is known to those skilled in the art and sent to two controlling units 15, 20.

In first control unit 15, first setpoint value mi1 for the internal torque is sent to a first drivability filter 50, and in second control unit 20, it is sent to a second drivability filter 55, the two drivability filters 50, 55 again being correspondent, i.e., ideally identical. First setpoint value mi1 for the internal torque is formed around the clutch zero crossing by two drivability filters 50, 55 in a manner which is known to those skilled in the art, in such a way that a transition is able to take place between the traction mode and the low-load mode and/or between the low-load mode and the traction mode in passing the clutch zero crossing smoothly and without drive train excitation. To this end, the time gradient of first setpoint value mi1 is reduced in absolute value at the clutch zero crossing, as shown in the FIGURE. The clutch zero crossing is characterized in that the torque on the clutch, so-called clutch torque mk, is equal to zero there, i.e., the internal torque of internal combustion engine 1 there corresponds to the torque loss of internal combustion engine 1. Accordingly, the setpoint value for clutch torque mksoll at the clutch zero crossing should be equal to zero, i.e., first setpoint value mi1 for the internal torque should correspond to torque loss mdverl at the clutch zero crossing. In general the following applies:

$$mksoll = mi1 - mdverl \quad (1)$$

and this yields for the clutch zero crossing:

$$mi1 = mdverl \quad (2).$$

Thus, according to equation (1), the knowledge of torque loss mdverl is necessary to determine setpoint value mksoll of the clutch torque. In two drivability filters 50, 55 according to the FIGURE, the curve of first setpoint value mi1 of the internal torque is plotted as a function of time t, the solid line representing the transition from low-load mode to traction mode and the dashed line represents the transition from traction mode to low-load mode. First setpoint value mi1 then undergoes clutch zero crossing 60 on reaching torque loss mdverl, clutch zero crossing 60 being reached for first drivability filter 50 when mi1=mdverl1 and, in the case of second drivability filter 55, clutch zero crossing 60 being reached when mi1=mdverl2.

To this end, first torque loss mverl1 is sent to first drivability filter 50 in first control unit 15, and second torque loss mdverl2 is sent to second drivability filter 55 in second control unit 20. In this way, clutch zero crossing 60 may be adapted to prevailing torque loss mdverl1 and/or mdverl2 in both drivability filters 50, 55. A second setpoint value mi2 for the internal torque, which corresponds to first setpoint value mi1 for the internal torque filtered through drivability filter 50, 55, is then available at the output of two drivability filters 50, 55. Second setpoint value mi2 is sent in first control unit 15 to a first minimal selection member 65 and in second control unit 20 to a second minimal selection member 70.

In addition, another requirement miasr for the internal torque is sent to first minimal selection member 65 and second minimal selection member 70. This additional requirement on the level of the internal torque may be, for example, a requirement for a traction control. Additionally or alternatively, at the level of the internal torque, one or more requirements for the internal torque may be sent to first minimal selection member 65 and second minimal selection member 70, e.g., from an ABS system, electronic stability control, cruise control, etc. It is assumed below as an example that in addition to second setpoint value mi2 for the internal torque, only one additional requirement in the form of an internal torque miasr of the traction control is sent to minimal selection members 65, 70. Traction control here usually requires a setpoint torque mdasr, which is not yet at the level of the internal torque.

Therefore, in a first addition member 115 of first control unit 15, first torque loss mdverl1 is added to torque requirement mdasr of the traction control, and in a second addition member 120 of second control unit 20, second torque loss value mdverl2 is added to requirement mdasr, in each to form requirement miasr of the internal torque by the traction control, this then being sent to minimal selection members 65, 70. Minimal selection members 65, 70 select the minimum of their two input quantities, relaying it as third setpoint value mi3 for the internal torque. Alternatively and for the case when no additional requirement for the internal torque is possible, minimal selection members 65, 70 and the coordination which is performed there, as described here, may also be omitted, and second setpoint value mi2 then corresponds to a third setpoint value mi3 for the internal torque.

Furthermore, a first compensation factor memory 75 is provided in first control unit 15, keeping various compensation factors stored and, depending on the operating state of internal combustion engine 1, selecting a compensation factor and delivering it to a third multiplication member 105, which also receives third setpoint value mi3 for the internal torque. Third multiplication member 105 multiplies the compensation factor predetermined by first compensation factor memory 75 times third setpoint value mi3 for the internal torque, thus yielding a resulting setpoint value mires1 for the internal torque at the output of third multiplication member 105, this setpoint value being sent to a first conversion unit 85.

Accordingly, a second compensation factor memory 80 is also provided in second control unit 20, storing multiple compensation factors and selecting one of the stored compensation factors, depending on the operating state of internal combustion engine 1 and forwarding this to a fourth multiplication member 110 in which the selected compensation factor is multiplied times third setpoint value mi3 for the internal torque. Thus a second resulting setpoint value mires2 for the internal torque is formed at the output of fourth multiplication member 110 and sent to a second conversion unit 90.

First conversion unit 85 converts first resulting setpoint value mires1 in a manner which is known to those skilled in the art through appropriate triggering of manipulated variables of second cylinder bank 10. In a gasoline engine, these manipulated variables include, for example, the firing angle, the air supply and the fuel injection quantity, and in a diesel engine include, for example, the fuel injection quantity and air supply. Accordingly, second conversion unit 90 converts second resulting setpoint value mires2 for the internal torque through suitable triggering of the manipulated variables of first cylinder bank 5. First resulting setpoint value mires1 for the internal torque may be different from second resulting setpoint value mires2 for the resulting torque even if both cylinder banks 5, 10 are activated, i.e., mdverl1=mdverl2, when same minimum value mimin is being formed in both control units 15, 20 but different compensation factors are selected by compensation factor memories 75, 80. However, it should now be assumed that when both cylinder banks 5, 10 are activated, the same compensation factor will be selected by both compensation factor memories 75, 80. For the case when both cylinder banks 5, 10 are activated, this amounts to value 1.

The case when first cylinder bank 5 is deactivated will now be considered below. This may be accomplished, for example, by second conversion unit 90 deactivating the intake and exhaust valves of all cylinders of first cylinder bank 5, i.e., causing them to close. The losses of internal combustion engine 1 change in this way. First cylinder bank 5 then no longer has any charge cycle losses. However, since the crankshaft is not deactivated, the pistons of the cylinders of first cylinder bank 5 continue to move, so there are also still friction losses in first cylinder bank 5 and first cylinder bank 5 also still has losses due to the activated secondary units. However, the losses of first cylinder bank 5 during their deactivation are lower than the losses of second cylinder bank 10 in which there are still charge cycle losses.

As a result, first torque loss mdverl1 during deactivation of first cylinder bank 5 is greater than second torque loss mdverl2. During deactivation of first cylinder bank 5, second compensation factor memory 80 selects the value zero as the compensation factor, yielding the value zero as second resulting setpoint value mires2. However, first compensation factor memory 75 selects a value between approximately 1.95 and 2 during deactivation of first cylinder bank 5, because now second cylinder bank 10 must yield approximately twice the power to replace first cylinder bank 5, which has been deactivated. Because of the different losses of first cylinder bank 5 and second cylinder bank 10 during deactivation of first cylinder bank 5, however, an adaptation of first torque loss mdverl1, which is the basis for forming first resulting setpoint value mires1 for the internal torque, is provided according to the exemplary embodiment and/or the exemplary method of the present invention. This adjustment takes place according to the exemplary embodiment and/or the exemplary method of the present invention at least in one of the steps described previously for forming first resulting setpoint value mires1 for the internal torque.

The losses of first cylinder bank 5 and the losses of second cylinder bank 10 in at least one of these steps are taken into account jointly for forming resulting setpoint value mires1 for the internal torque. The different losses of first cylinder bank 5 and second cylinder back 10 during deactivation of first cylinder bank 5 are better taken into account for forming first resulting setpoint value mires1 for the internal torque if the formation of first resulting setpoint value mires1 for the internal torque is influenced jointly in several steps via the losses of first cylinder bank 5, i.e., second torque loss mdverl2, and the losses of second cylinder bank 10, i.e., of first torque loss mdverl1. To this end, it is particularly advantageous if a joint loss value is formed from the losses of first cylinder bank 5 and the losses of second cylinder bank 10 and is taken into account for forming first resulting setpoint value mires1 for the internal torque. For example, the losses of first cylinder bank 5 and the losses of second cylinder bank 10 may be taken into account in the step for converting the gas pedal position into first setpoint value mi1 for the internal torque of second cylinder bank 10. During deactivation of first cylinder bank 5, first resulting setpoint value mires1 for the internal torque is of course no longer the internal torque value to be converted by both cylinder banks 5, 10 but instead is only the internal torque value to be converted by second cylinder bank 10.

If both cylinder banks 5, 10 are activated, then first conversion unit 85 causes the conversion of half of first resulting setpoint value mires1 for the internal torque by second cylinder bank 10. Second conversion unit 90 prompts the conversion of half of second resulting setpoint value mires2 for the internal torque by first cylinder bank 5.

During deactivation of first cylinder bank 5, first conversion unit 85 prompts the conversion of full first setpoint value mires1 for the internal torque by second cylinder bank 10.

The losses of first cylinder bank 5 and the losses of second cylinder bank 10 in the step of conversion of the gas pedal position to first setpoint value mi1 of the internal torque to be converted by second cylinder bank 10 are taken into account, for example, by forming minimum value mimin for the first setpoint value of the internal torque to be converted by second cylinder bank 10 from the losses of first cylinder bank 5 as well as the losses of second cylinder bank 10.

Additionally or alternatively, it is also possible to provide for the losses of first cylinder bank 5 and the losses of second cylinder bank 10 to be taken into account in the step for forming second setpoint value mi2 for the internal torque to be converted by second cylinder bank 10 by filtering the clutch zero crossing of first setpoint value mi1 for the internal torque to be converted by second cylinder bank 10 via first drivability filter 50. This may be accomplished, for example, by ascertaining clutch zero crossing 60 as a function of the losses of first cylinder bank 5 as well as those of second cylinder bank 10.

Additionally or alternatively, it is also possible for the losses of first cylinder bank 5 and the losses of second cylinder bank 10 to be taken into account by coordinating multiple requirements for the internal torque to be converted by a second cylinder bank 10 via first minimal selection member 65 in a step for forming third setpoint value mi3 for the internal torque to be converted by second cylinder bank 10. This may be accomplished, for example, by the fact that at least one of these requirements for the internal torque to be converted by second cylinder bank 10 is modified as a function of the losses of first cylinder bank 5 and the losses of second cylinder bank 10, in particular by superimposing the losses of first cylinder bank 5 and the losses of second cylinder bank 10. In the present example, requirement miasr formed by the traction control is modified.

The FIGURE shows first control unit 15 designed in such a way that the losses of first cylinder bank 5 and the losses of second cylinder bank 10 are taken into account in all three steps mentioned as examples to form first resulting setpoint value mires1 for the internal torque to be converted by second cylinder bank 10. To this end, first torque loss mdverl1 and second torque loss mdverl2 are sent to a third addition member 25, where they are added together. Resulting sum mdverl1+mdverl2 is then divided by a divisor X in a division member 125. In addition, a switch 130 is provided, either connecting first torque loss mdverl1 directly to an input 145 of first multiplication member 95 for multiplication times function f(nmot) or connecting the output of division member 125 to input 145 of first multiplication member 95. If both cylinders 5, 10 are activated, then switch 130, which is not triggered suitably in the manner shown here, connects first torque loss mdverl1 directly to aforementioned input 145 of first multiplication member 95.

When first cylinder bank 5 is deactivated and only second cylinder bank 10 is activated, switch 130 is triggered, in such a way that it connects the output of division member 125 to said input 145 of first multiplication member 95. In the exemplary embodiment described here, divisor X is equal to 2, in such a way that an average of first torque loss mdverl1 and second torque loss mdverl2 is obtained at the output of division member 125. This average is multiplied times function f(nmot) during deactivation of first cylinder bank 5 to form minimum value mimin, while f(nmot) may be set as already described above even during deactivation of first cylinder bank 5, while second cylinder bank 10 is still activated. This FIGURE shows that the output of controlled switch 130 is sent not only to aforementioned input 145 of first multiplication member 95 but is also sent to first drivability filter 50 and first addition member 115 to form requirement miasr of the traction control at the level of the internal torque.

For the case when second torque loss mdverl2 is to be taken into account in addition to first torque loss mdverl1 in first control unit 15 for only one or two of the aforementioned steps to form first resulting setpoint value mires1 for the internal torque to be converted by second cylinder bank 10, controlled switch 130 may also be supplied either only to aforementioned input 145 of first multiplication member 95 or to the torque loss input indicated in the FIGURE by reference numeral 135 of first drivability filter 50 or to torque loss input 140 of first addition member 115. Alternatively, it is plausible to provide for controlled switch 130 to be assigned in the manner described here to exactly two of torque loss inputs 135, 140, 145 to implement a modification of these two torque loss inputs via second torque loss mdverl2.

Use of drivability filters 50, 55 and/or minimal selection members 65, 70 for coordinating the torque is not absolutely necessary. Without torque coordination, second setpoint value mi2 would correspond to third setpoint value mi3. Without drivability filtering, first setpoint value mi1 would correspond to second setpoint value mi2.

However, it is decisive for the exemplary embodiment and/or the exemplary method of the present invention that in at least one of the steps before forming first resulting setpoint value mires1 for the internal torque to be converted by second cylinder bank 10, both the losses of first cylinder bank 5, represented by second torque loss mdverl2, as well as the losses of second cylinder bank 10, represented by first torque loss mdverl1, are taken into account for forming a setpoint value mi1, mi2, mi3 for the internal torque to be converted by second cylinder bank 10. This is taken into account in the manner described here to form minimum value mimin as a function of first torque loss mdverl1 and second torque loss mdverl2 and/or by forming clutch zero crossing 60 as a function of first torque loss mdverl1 and second torque loss mdverl2 and/or by forming at least one requirement miasr of the internal torque to be coordinated at first minimal selection member 65 as a function of first torque loss mdverl1 and second torque loss mdverl2.

Thus if clutch zero crossing 60 is ascertained as a function of first torque loss mdverl1 and second torque loss mdverl2 in first drivability filter 60 during deactivation of first cylinder bank 5, then the characterization of clutch zero crossing 60 in first drivability filter 50 is to be changed from mdverl1 to (mdverl1+mdverl2)/x, as is also shown in parentheses in the FIGURE.

Depending on the type of torque coordination to be implemented, instead of minimal selection members 65, 70, a maximal selection member may also be provided, so that the maximum of its input variables is selected and delivered as third setpoint value mi3.

If during deactivation of first cylinder bank 5, first resulting setpoint value mires1 for the internal torque must be converted completely by second cylinder bank 10, this still means that first conversion unit 85 prompts only the conversion of half the resulting setpoint value mires1 by second cylinder bank 10. In this operating state, the compensation factor selected by first compensation factor memory 75 corresponds approximately to a value of 2, so this ensures that now approximately third setpoint value mi3 is converted by second cylinder bank 10 at the output of first minimal selection member 65. During the operating state in which both cylinder banks 5, 10 are activated, only half of third setpoint value mi3 is converted by second cylinder bank 10 and half by first cylinder bank 5, because the compensation factor selected at both compensation factor memories 85, 80 corresponds to a value of 1 in this operating state. Thus, on the whole, in the two operating states of internal combustion engine 1 described here, third resulting setpoint value mi3 is converted on the whole.

In addition, in a modification (like the second embodiment, i.e., second exemplary embodiment) of the first exemplary embodiment illustrated in the FIGURE, it may also be provided that torque variables mdverl1, mimax and mdasr occurring in two control units 15, 20 will be taken into account there only in the amount of half of their value and, for that, during the conversion by first conversion unit 85 and second conversion unit 90, the complete second resulting setpoint value mires2 is converted by first cylinder bank 5 and the complete first resulting setpoint value mires1 is converted by second cylinder bank 10.

The compensation factor selected by compensation factor memories 75, 80 is 1 when each cylinder bank 5, 10 is activated. When first cylinder bank 5 is deactivated, in this second embodiment first compensation factor memory 75 will also select approximately a value of 2 as the compensation factor and the compensation factor selected by second compensation factor memory 80 will assume a value of zero. However, in this case divisor X is selected to be 1. Maximum value mimax in this second embodiment corresponds to the maximal internal torque to be converted by first cylinder bank 5 and/or second cylinder bank 10 alone, whereas in the first exemplary embodiment described previously, with twice the magnitude, it corresponds to the maximal internal torque to be converted by internal combustion engine 1, i.e., by first cylinder bank 5 and second cylinder bank 10 together.

First conversion unit 85 in the this second embodiment will thus completely convert first resulting setpoint value mires1 via second cylinder bank 10 in both operating modes described here, i.e., for the case when both cylinder banks 5, 10 are activated and also for the case when first cylinder bank 5 is deactivated and only second cylinder bank 10 is activated. Accordingly, second conversion unit 90 will completely convert second resulting setpoint value mires2 via first cylinder bank 5 in both operating modes described here of this alternative second embodiment. While the first cylinder bank is deactivated, second resulting setpoint value mires2 is equal to zero because the compensation factor selected by second compensation factor memory 80 is equal to zero in this operating state.

During the changeover from full-engine operation in which both cylinder banks 5, 10 are activated to half-engine operation in which only second cylinder bank 10 is activated and first cylinder bank 5 is deactivated, second torque loss mdverl2 is taken into account in first control unit 15 in the manner described here, but during the non-steady-state changeover operation even the compensation factor delivered by first compensation factor memory 75 is ramped up continuously from a value of 1 to a value of 2, e.g., via a predetermined ramp function, and the compensation factor delivered by second compensation factor memory 80 is likewise reduced continuously from a value of 1 to a value of 0 via a ramp function. In this way, the non-steady-state changeover operation is implemented in the most comfortable possible manner. Second torque loss mdverl2 in first control unit 15 may also be taken into account only at the end of the non-steady-state changeover operation through corresponding activation of controlled switch 130.

As an alternative, second torque loss mdverl2 could already be taken into account at the start of the non-steady-state changeover operation in first control unit 15 through appropriate activation of control switch 130 in forming first resulting setpoint value mires1, as described previously, divisor X also being increased during the changeover operation via a ramp function from a first value <2 at the start of the changeover operation to a value of 2 at the end of the changeover operation. Values <2 may be calibrated suitably at the start of the changeover operation for divisor X, for example, so that the output of division member 125 at the start of the changeover operation still corresponds to torque loss mdverl1 and/or torque loss mdverl in full-engine operation. For the known steady-state changeover operation from half-engine operation to full-engine operation, the compensation factors and divisor X may then again be returned to the corresponding values for full-engine operation in a corresponding manner, e.g., also according to a ramp function, i.e., the compensation factors may again be returned to a value of 1 and value X may again be returned to values <2 calibrated as described. The reasoning described here for value X is also valid for the case when each of the two control units 15, 20 stipulates the total internal setpoint torque to be converted by internal combustion engine 1.

For the case when both control units 15, 20 stipulate only the internal setpoint torque to be converted by a particular cylinder bank 5, 10 in the changeover operation from full-engine operation to half-engine operation, divisor X is increased from a suitably calibrated value <1 at the start of the changeover operation to a value of 1 at the end of the changeover operation, e.g., according to a ramp. Value <1 may be calibrated suitably, for example, so that at the start of the changeover operation, approximately the double value of first torque loss mdverl1 is calibrated at the output of division member 125. In changeover from half-engine operation to full-engine operation, divisor X is then returned conversely from value 1 to calibrated value <1, e.g., according to a ramp.

During the non-steady-state changeover between half-engine operation and full-engine operation and/or between full-engine operation and half-engine operation, first control unit 15 assumes predominantly the formation and conversion of the internal torque to be converted by internal combustion engine 1. In steady-state half-engine operation, first control unit 15 completely assumes the formation and conversion of the internal torque to be delivered by internal combustion engine 1. Expressed in different terms, first cylinder bank 5 in half-engine operation may also be imagined as a perfect engine which does not have any losses and consequently need not convert any internal torque to compensate for such losses. However, as described above, in reality first cylinder bank 5 does have losses, so they are allocated to first control unit 15 in the manner described here and are converted by it via second cylinder bank 10. Thus according to the exemplary embodiment and/or the exemplary method of the present invention, all losses of internal combustion engine 1 in steady-state half-engine operation may be compensated via first control unit 15 and second cylinder bank 10 alone.

The compensation factors selected by compensation factor memories 75, 80 may also be selected for compensation of differences in the internal torques to be converted by two cylinder banks 5, 10 on the basis of an asynchronous activation of the throttle valves of two cylinder banks 5, 10, which may be provided, if necessary, in activation or deactivation of half-engine operation. Such compensation could then additionally be taken into account during the non-steady-state changeover operations between half-engine operation and full-engine operation and/or between full-engine and half-engine operation described above.

By stipulating minimum value mimin below which first setpoint value mi1 does not drop at the output of first interpolation member 40 and/or second interpolation member 45, a stable engine state is ensured during idling of internal combustion engine 1.

The exemplary embodiment and/or the exemplary method of the present invention has been described here for an internal combustion engine having two cylinder banks. However, it may also be implemented accordingly for internal combustion engines having a plurality of cylinder banks, at least one cylinder bank being deactivatable and at least one cylinder bank being activated while the at least one cylinder bank is deactivated, the control unit allocated to the at least one activated cylinder bank taking into account the losses of all deactivated cylinder banks by superimposing torque losses of all cylinder banks and, if necessary, forming an average. It is quite possible for multiple cylinder banks to be deactivated while at the same time one or more cylinder banks are activated. Each cylinder bank may be allocated its own control unit as in the method illustrated in the FIGURE. If multiple cylinder banks are operable only jointly, e.g., only jointly activatable and/or deactivatable, they may also be triggered by a shared control unit.

The invention claimed is:

1. A method for operating an internal combustion engine having cylinder banks, at least a first one of the cylinder banks being deactivatable, the method comprising:

taking into account, at least during the deactivation of the first one of the cylinder banks, losses of the first one of the cylinder banks and losses of a second one of the cylinder banks are taken into account in activating the second one of the cylinder banks;

forming a default value for an output variable of the second one of the cylinder banks by proceeding in steps in a first control unit, wherein in at least one of the steps, the losses of the first one of the cylinder banks and the losses of the second one of the cylinder banks are both taken into account by a second control unit for forming the default value.

2. The method of claim 1, wherein a joint loss value is formed from the losses of the first one of the cylinder banks and the losses of the second one of the cylinder banks is taken into account in forming the default value.

3. The method of claim 1, wherein the formation of the default value in steps is influenced by taking into account the losses of the first one of the cylinder banks and the losses of the second one of the cylinder banks.

4. The method of claim 1, wherein the losses of the first one of the cylinder banks and the losses of the second one of the cylinder banks are taken into account in a step for converting an operating element position into a first default value for the output variable of the second one of the cylinder banks.

5. The method of claim 4, wherein a minimum value for the first default value is formed from the losses of the first one of the cylinder banks and the losses of the second one of the cylinder banks.

6. The method of claim 1, wherein the losses of the first one of the cylinder banks and the losses of the second one of the cylinder banks are taken into account in a step for forming a second default value for the output variable of the second one of the cylinder banks by filtering a clutch zero crossing of the default value for the output variable of the second one of the cylinder banks.

7. The method of claim 6, wherein the clutch zero crossing is ascertained as a function of the losses of the first one of the cylinder banks and the losses of the second one of the cylinder banks.

8. The method of claim 1, wherein the losses of the first one of the cylinder banks and the losses of the second one of the cylinder banks are taken into account in a step for forming a third default value for the output variable of the second one of the cylinder banks by coordinating multiple requirements for the output variable of the second one of the cylinder banks.

9. The method of claim 8, wherein at least one of the requirements for the output variable of the second one of the cylinder banks is modified as a function of the losses of the first one of the cylinder banks and the losses of the second one of the cylinder banks by superimposing the losses of the first one of the cylinder banks and the losses of the second one of the cylinder banks.

10. A device for operating an internal combustion engine having cylinder banks, at least a first one of the cylinder banks being deactivatable, comprising:

a control arrangement to take into account losses of the first one of the cylinder banks and losses of a second one of the cylinder banks in activating the second one of the cylinder banks during deactivation of the first one of the cylinder banks; and a first control arrangement to form a default value for an output variable of the second one of the cylinder banks which proceeds in steps therein, the first control arrangement taking into account, in at least one of the steps, from a second control arrangement the losses of the first one of the cylinder banks and the losses of the second one of the cylinder banks for forming the default value.

* * * * *